US007959526B2

(12) United States Patent
Petela

(10) Patent No.: US 7,959,526 B2
(45) Date of Patent: Jun. 14, 2011

(54) GOLF BALL POSITION MARKING DEVICE AND METHOD OF USE

(76) Inventor: Peter J. Petela, Draper, UT (US)

( * ) Notice: Subject to any disclaimer, the term of this patent is extended or adjusted under 35 U.S.C. 154(b) by 202 days.

(21) Appl. No.: 12/327,505

(22) Filed: Dec. 3, 2008

(65) Prior Publication Data

US 2010/0137077 A1 Jun. 3, 2010

(51) Int. Cl.
*A63B 57/00* (2006.01)

(52) U.S. Cl. ..... 473/406

(58) Field of Classification Search ..... 473/406.285, 473/286, 386, 409
See application file for complete search history.

(56) References Cited

U.S. PATENT DOCUMENTS

| | | | | |
|---|---|---|---|---|
| 1,756,141 | A * | 4/1930 | Spellmeyer | 222/501 |
| 2,738,214 | A | 3/1956 | Zimmers | |
| 2,892,633 | A * | 6/1959 | Eckert | 473/285 |
| 3,442,544 | A | 5/1969 | Faber | |
| 3,669,427 | A | 6/1972 | Curtis | |
| 4,313,632 | A | 2/1982 | King et al. | |
| 4,553,752 | A * | 11/1985 | Bagg | 473/300 |
| 4,660,837 | A * | 4/1987 | Bressie | 473/386 |
| 4,728,134 | A | 3/1988 | Allen | |
| 4,844,526 | A | 7/1989 | Young | |
| D306,874 | S * | 3/1990 | Lapin | D19/4 |
| 5,423,584 | A | 6/1995 | Pasternak | |
| 5,460,366 | A | 10/1995 | Pugh | |
| 5,651,571 | A | 7/1997 | Diveto | |
| 5,662,366 | A | 9/1997 | Fraske | |
| 5,725,441 | A * | 3/1998 | Jensen et al. | 473/251 |
| 5,829,806 | A | 11/1998 | Sykes | |
| 5,997,062 | A | 12/1999 | Schwartz | |
| 6,059,334 | A | 5/2000 | LaCourse | |
| 6,257,635 | B1 | 7/2001 | Torelli | |
| 6,692,373 | B2 * | 2/2004 | Hultquist | 473/285 |
| 6,695,370 | B2 | 2/2004 | Johnson | |
| 6,699,144 | B1 * | 3/2004 | Kvitek | 473/408 |
| 6,716,118 | B1 | 4/2004 | Asta | |
| 6,942,584 | B2 * | 9/2005 | Kvitek | 473/408 |
| 2002/0022539 | A1 | 2/2002 | Smith et al. | |
| 2003/0148832 | A1 | 8/2003 | Hultquist | |
| 2003/0195054 | A1 | 10/2003 | Rioux | |
| 2004/0092340 | A1 | 5/2004 | Kvitek | |
| 2007/0054755 | A1 * | 3/2007 | Cornfield | 473/406 |
| 2007/0212160 | A1 * | 9/2007 | Buzil | 401/214 |

FOREIGN PATENT DOCUMENTS

| | | |
|---|---|---|
| GB | 2128484 A | 5/1984 |
| GB | 2282973 A | 4/1995 |
| GB | 2305865 A | 4/1997 |

* cited by examiner

*Primary Examiner* — Steven Wong
(74) *Attorney, Agent, or Firm* — Pierce Atwood LLP; Kevin M. Farrell; Katherine A. Wrobel

(57) ABSTRACT

A golf ball position marking device enables a user to reliably and unobtrusively mark the position of a golf ball on a putting green. The golf ball position marking device comprises a putting green contact surface, a marker material dispensing port, a marker material dispensing actuator and a marker material reservoir. The putting green contact surface is sized and shaped to permit stable positioning of the golf ball position marking device on a putting green in close proximity to a golf ball on the putting green thereby providing oriented alignment of the golf ball position marking device with the golf ball on the putting green. Activation of the marker material dispensing actuator results in the dispensing of a marker material from the marker material reservoir onto the putting green at a predetermined vector position relative to the point where the golf ball contacts the putting green.

7 Claims, 5 Drawing Sheets

GOLF BALL POSITION MARKING DEVICE AND METHOD OF USE

BACKGROUND

1. Field of the Invention

This invention relates to the game of golf. More particularly, this invention relates to a novel device and associated method of use for producing a golf ball position marker that will conveniently mark the position of a golf ball on a putting surface.

2. Discussion of Background Information

A golfer commonly displaces his stationary golf ball with another object that functions as a position marker while other participants have their turn at playing a particular hole. By marking the spot where a ball comes to rest on a putting green, a player is able to accurately reapply and reposition his golf ball when his turn to play resumes.

Despite the wide range of available marking devices, existing golf ball position markers present practical disadvantages to their use during play. The most commonly used devices are small coin-sized plastic or metal markers that golfers carry loosely in their pockets or secure to the back of a golf glove, golf shoe, putter end or divot repair tool. Practical disadvantages of these coin and snap-type devices include the creation of a three-dimensional physical presence on the playing surface that may interfere with the path of a moving golf ball hit by another player. A collision with one of these three-dimensional markers will alter the speed of a traveling golf ball and/or redirect the path of the ball, both of which are undesirable results. Furthermore, such a collision may move the marker, thereby defeating the purpose of employing such a position marker at all. If a player knowingly selects a ball path that might result in such a collision, the marker will require removal, which also defeats the purpose in having placed the device on the green for noting the resting position of a ball temporarily removed from the green. Furthermore, intentionally moving a golf ball position marker significantly reduces the speed of play and forces a golfer to bend uncomfortably and/or kneel repeatedly while moving the marker. More importantly, moving a golf ball marker always presents a risk that the golfer will misidentify the original location of the marker, misposition the ball upon return to the green and incur a one-stroke penalty.

In addition to their disruptive physical presences, these conventional golf ball markers are loosely-held items that players easily lose or misplace. Many golfers who commonly misplace these items resort to improvisation during play, using coins, golf tees or other small objects to mark the positions of their golf balls. Although snap-type ball markers are designed to reduce the risk of loss because of their integrated snap attachment mechanism, golfers often grow aggravated while repeatedly engaging and disengaging such markers from their gloves or shoes.

Over the years, a number of inventors have proposed alternatives in an attempt to address the deficiencies of these common, loosely held, retrievable, three-dimensional position markers. For example, U.S. Publication No. 20040092340 to Kvitek discloses a mechanical device comprising a powder chamber selectively actuated for dispensing powder onto a playing surface to mark the position of a golf ball. Unfortunately, powder-based marking devices present their own disadvantages. For example, powders are susceptible to scattering on windy days and that precludes producing an adequately sustainable mark for successful and accurate replacement of a golf ball.

Even under windless conditions, powder marks are deficient for a number of reasons. First, powder-based marking devices apply a powder to the green and powders comprise fine granules of matter. These granules inherently change the texture and coefficient of friction of the rolling surface, which in turn alters the speed and/or path of a rolling golf ball. Depending on the cohesive nature and particle size of the powder and the amount of ambient moisture present during play, the powder may stick to a rolling golf ball, filling the dimples on the ball and altering aerodynamics when the ball is later driven.

Second, powder markers may form a three-dimensional mound depending on the amount of powder exiting the device upon actuation. Physics dictates that controlling the release of a precise amount of fine particulate matter in a precisely conformed shape is unreliably repeatable and dependent upon a number of factors, including trajectory of release, distance to the playing surface and gravity. Releasing a mound of powder creates a powder position marker that also may alter the path of a rolling golf ball. Unlike three-dimensional coin or snap-type markers, the powder marker, however, is unmovable and must be completely wiped or washed from the playing surface to prevent interference with a rolling golf ball. The process of displacing the powder marker may result in slight damage to the green as the powder is dissolved or crushed into the surface or aggressively wiped away. Moreover, powder marks may leave a long-lasting visual residue scattered across the green and that may distract other golfers, a prohibition on most impeccably maintained golf course greens.

U.S. Publication No. 20020022539 to Smith et al. proposes another alternative, a device that attaches to the handle end of a putter or some other similarly elongated object. The reference discloses a device having a mechanically activated golf ball retriever comprising an electromagnet that engages with a selectively activated laterally sliding magnet to trigger release and retrieval of a stainless steel ball marker. Like coin and snap-type markers, the stainless steel marker of Smith et al. imparts a notable physical presence on the putting surface that may disrupt the path of a rolling ball. The device is distracting to a putting golfer and renders that club more cumbersome to carry. Furthermore, similar to the snap-type ball markers, the dispensed stainless steel ball marker requires retrieval and replacement into its original holding position. Golfers may find this repetitive investment of additional time and effort cumbersome and aggravating to such an extent that they stop returning their markers to intended storage locations and lose or misplacement their markers. Like the powder device, the Smith et al. device fails to provide a mechanism for repeatedly orienting the device in relation to a resting golf ball for accurate placement of the marker. Marker placement will vary depending on a number of factors such as trajectory of release, distance to the playing surface and gravity.

None of the above inventions, taken either singly or in combination, adequately address or resolve the aforementioned problems. Therefore, a need exists for a convenient-to-use, non-retrievable golf ball position marking device that marks the position of a golf ball on a putting green in a highly visible, highly accurate manner without disrupting the path of a rolling ball or leaving a distracting and/or damaging long-lasting residue.

SUMMARY OF THE INVENTION

The present invention solves the problems associated with marking a golf ball on a putting green and provides a device and method for reliably marking a golf ball position.

The present invention is directed to a golf ball position marking device that enables a user to reliably and unobtrusively mark the position of a golf ball on a putting green. The golf ball position marking device comprises a putting green contact surface, a marker material dispensing port, a marker material dispensing actuator and a marker material reservoir. The putting green contact surface is sized and shaped to permit stable positioning of the golf ball position marking device on a putting green in close proximity to a golf ball on the putting green thereby providing oriented alignment of the golf ball position marking device with the golf ball on the putting green. Additionally, the marker material dispensing port is positioned such that when the golf ball position marking device is positioned in oriented alignment relative to the golf ball, activation of the marker material dispensing actuator results in dispensing a marker material from the marker material reservoir onto the putting green at a predetermined vector position relative to the point where the golf ball contacts the putting green.

The present invention is also directed to a method for using a golf ball position marking device. First, the method comprises providing a golf ball position marking device comprising a putting green contact surface, a marker material dispensing port, a marker material dispensing actuator, and a marker material reservoir. The putting green contact surface is sized and shaped to permit stable positioning of the golf ball position marking device on a putting green in close proximity to a golf ball on the putting green thereby providing oriented alignment of the golf ball position marking device with the golf ball on the putting green. Additionally, the marker material dispensing port is positioned such that when the golf ball position marking device is positioned in oriented alignment relative to the golf ball, activation of the marker material dispensing actuator results in the dispensing of a marker material from the marker material reservoir onto the putting green at a predetermined vector position relative to the point where the golf ball contacts the putting green.

The method further comprises positioning the golf ball position marking device on a putting green in close proximity to a golf ball on the putting green and aligning the golf ball position marking device with the golf ball on the putting green. Once the golf ball position marking device has been positioned and aligned, the method further comprises activating the marker material dispensing actuator, resulting in the dispensing of a marker material from the marker material reservoir through the marker material dispensing port and onto the putting green at a predetermined vector position relative to the point where the golf ball contacts the putting green.

BRIEF DESCRIPTION OF THE DRAWINGS

These and other features, aspects and advantages of the present invention will become better understood with reference to the following description, appended claims, and accompanying drawings where:

DETAILED DESCRIPTION

The present invention includes a golf ball marking device and method for accurately and visibly marking the position of a resting golf ball on a putting green. A golfer may efficiently and accurately orient the device of the present invention in relation to a resting golf ball for the creation of a precisely placed position marker that neither obstructs a projected ball path nor leaves a long-lasting, distracting and potentially damaging residue on a putting green surface. Additionally, the formed position marker requires no retrieval and conveniently dissipates without harming ground water or greenery.

Figure 1A:
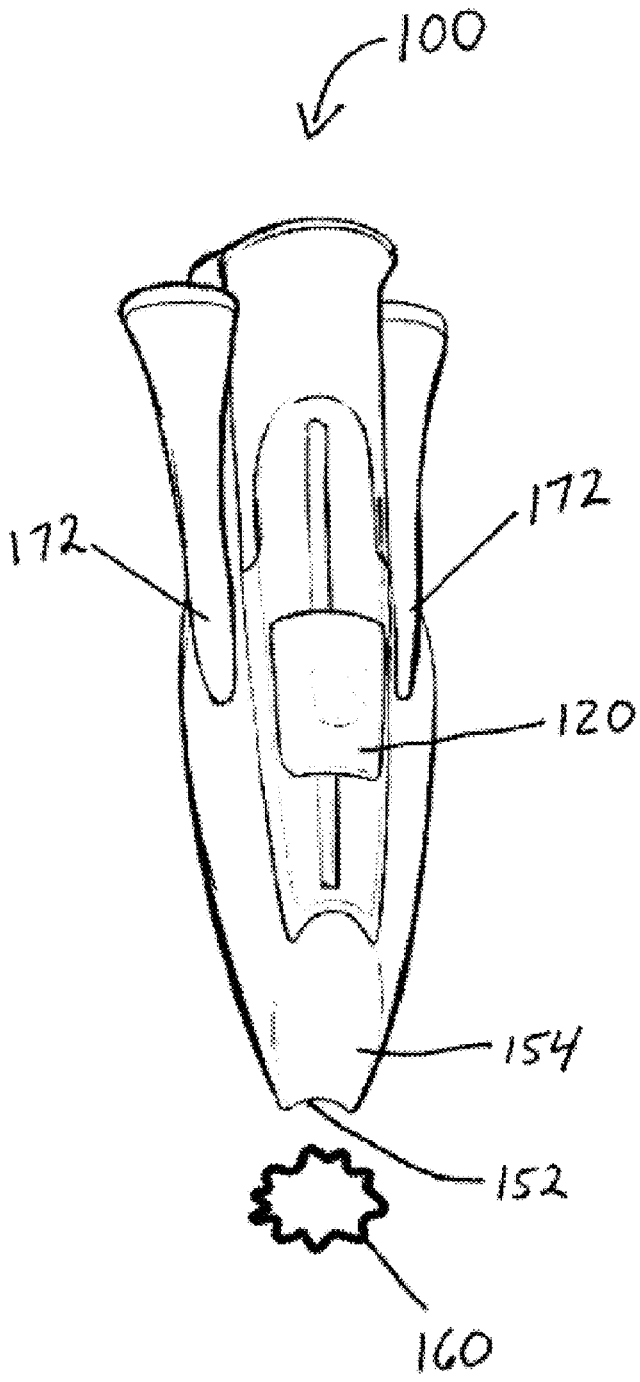
FIG. 1A shows a front perspective view of one embodiment of a golf ball position marking device.
Figure 1B:
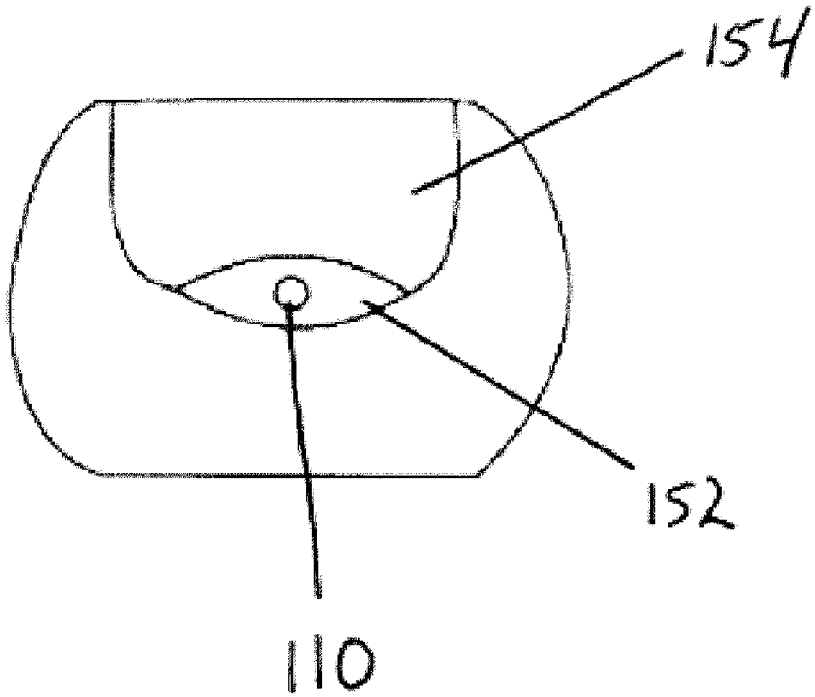
FIG. 1B shows an end view of the golf ball position marking device of FIG. 1A.
Figure 1C:
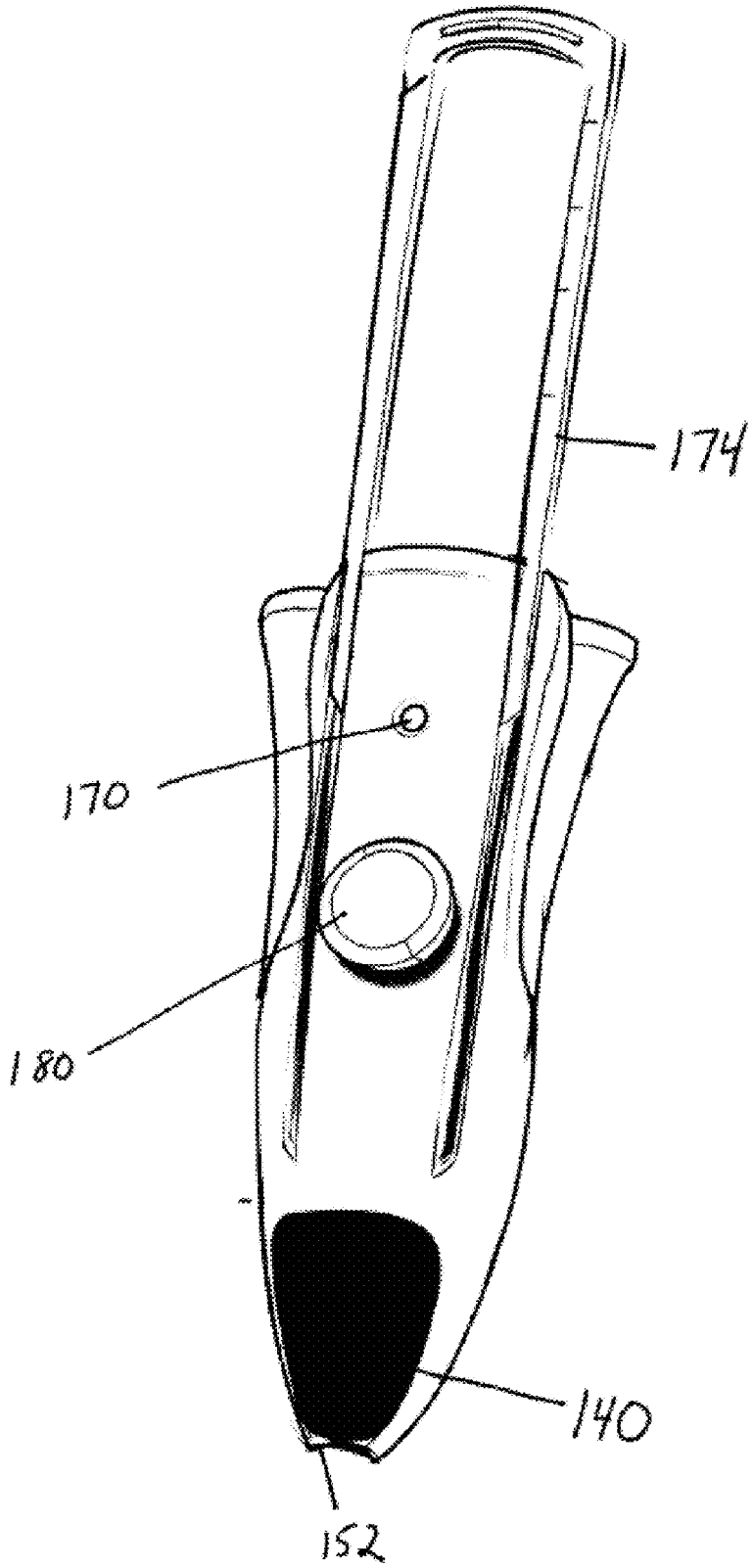
FIG. 1C shows a rear perspective view of the embodiment of the golf ball position marking device of FIG. 1A.

Turning now to FIGS. 1A through 1C, one embodiment of a golf ball position marking device 100 of the present invention comprises a marker material reservoir (not shown), marker material dispensing port 110, a marker material dispensing actuator 120, and a putting green contact surface 140. The golf ball position marking device 100 produces a formed marker 160 by projecting stored marker material onto a playing surface in close proximity to a resting ball. The marker material may be any number of agents or compounds, such as liquids, gels, or foams, as long as the material possesses relevant characteristics: The material must present no harm to the playing surface and must coat the playing surface so as to form a low-profile formed marker 160. Because of this flat profile, the formed marker 160 presents no substantial depth or volume of material that would deflect a rolling ball from its path of travel. Furthermore, because the formed marker 160 creates no interference with the path of a rolling golf ball, the formed marker 160 requires no subsequent removal and replacement when another golfer targets a ball path that would intersect with the position of the formed marker 160.

For example, the marker material that forms the formed marker 160 may be any fluid that aerates and foams when propelled from the marker material reservoir. Preferably, the marker material forms a thin layer of visible foam that coats the blades of putting green grass to form a non-tacky, cohesive, substantially round, flat formed marker 160 that withstands windy conditions. Such marking material may be selected from a number of known foaming agents that possesses the characteristics of being ground water safe when dissolved. This material for example may be water, glycerin, diluted glycerin, or castile soap. The foaming marking material should create a formed marker 160 that lasts for a predetermined period of time sufficient for replacement of the golf ball. The formed marker 160 either automatically dissolves or disperses, dissipates, and/or evaporates under the application of force in the plane of the formed marker 160, such as that imparted through a wiping motion of a foot or club. Lastly, a user may select the marker material so that the formed marker 160 has a low coefficient of friction and thereby neither slows the path of a rolling golf ball nor sticks to the surface of a golf ball, potentially filling the aerodynamic golf ball dimples.

Figure 2:
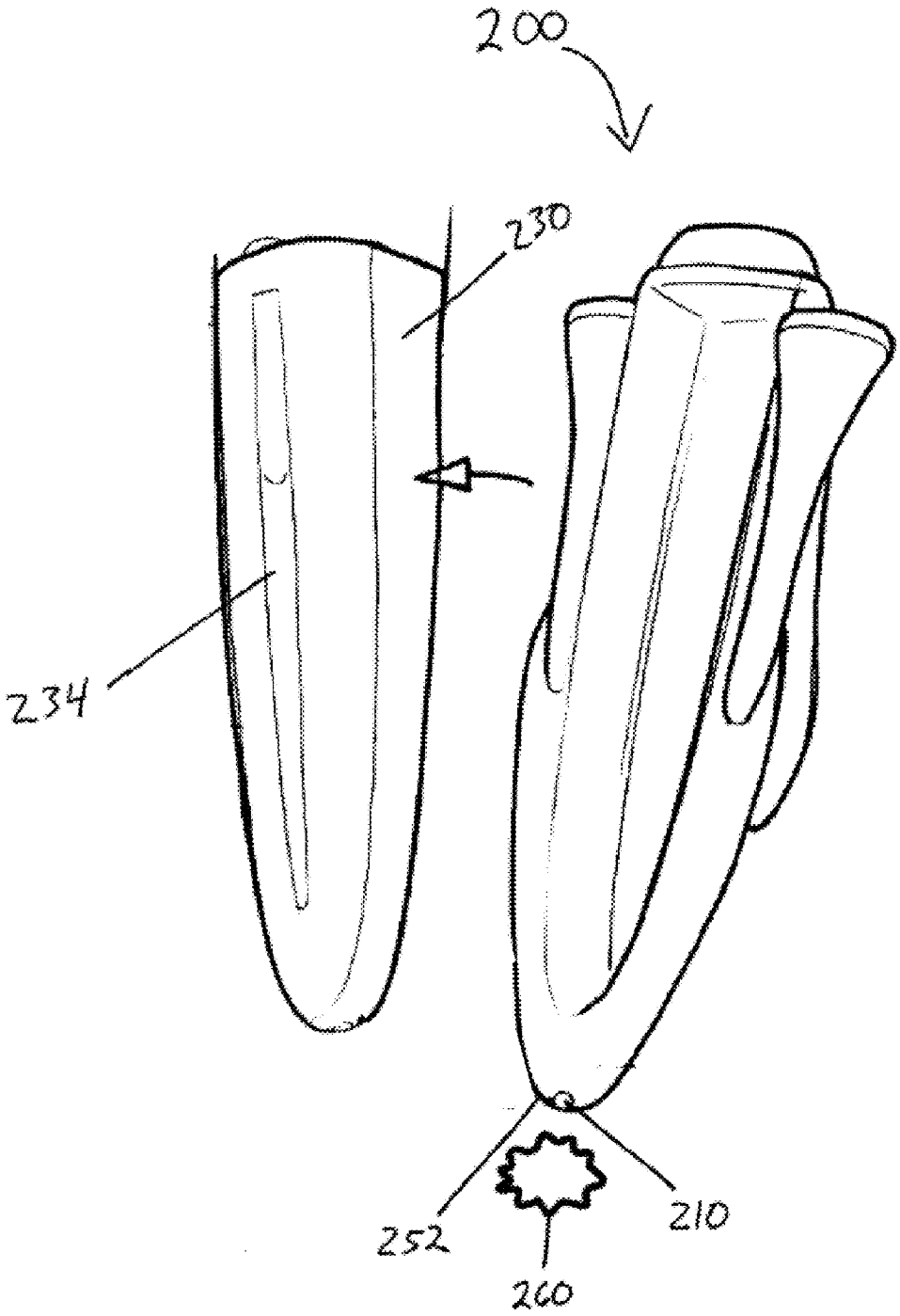
FIG. 2 shows a perspective view of another embodiment of a golf ball position marking device.

The golf ball position marking device 100 contains this marking material in a reservoir that may be internal or external, and that may be refillable or disposable, such as a disposable replacement cartridge. In the embodiment of FIGS. 1A through 1C, the golf ball position marking device 100 comprises an internal, refillable marker material reservoir. As depicted in the embodiment of FIG. 2, the golf ball position marking device 100 also may comprise a level indicator 234 for indicating the amount of marker material remaining in the marker material reservoir. Returning to the embodiment of FIGS. 1A through 1C, a golf ball position marking device 100 comprising an internal, refillable marker material reservoir further comprises a refill hole 170 for receiving a decanter from which marking material transfers into the internal reservoir. In an alternate embodiment, the refill hole 170 may further receive a connective external cartridge-type reservoir (not shown) such that the golf ball position marking device 100 is fed from an external storage component. In yet another embodiment, the refill hole 170 may be a larger opening sized for receiving a disposable refill cartridge that connects to the internal dispensing mechanism, thereby enabling marker material to flows through the golf ball position marking device 100 upon actuation.

In addition to retaining the marking material in an external or internal reservoir for repeated production of formed markers 160 that require no tedious retrieval, the golf ball position marking device 100 accurately places each formed marker 160 in relation to the position of the resting golf ball. The golf ball position marking device 100 achieves this result in part because the putting green contact surface 140 is sized and shaped to permit stable positioning of the golf ball position marking device 100 on a putting green in close proximity to a resting golf ball. In the embodiment of FIG. 1C, the putting green contact surface 140 is a substantially planar surface 140 inclined toward a central longitudinal axis of the golf ball position marking device 100 in the direction of the marker material dispensing port 110. In another embodiment, the substantially planar putting green contact surface 140 may be parallel to the central longitudinal axis of the golf ball position marking device 100 rather than sloped, and the material dispensing port 110 may be positioned and/or angled so as to eject a formed marker 160 on the putting green at a predetermined distance and location relative to the point at which the golf ball contacts the putting green. In all embodiments, the substantially planar putting green contact surface 140 provides sufficient surface area for stable contact with the green. That stability prevents undesirable rotation of the golf ball marking device 100 which might result in bumping and dislodging a resting golf ball. Such unwanted golf ball movement would result in a stroke penalty. Furthermore, placing the golf ball marking device 100 on a putting green in a stable position and in oriented alignment with the stationary golf ball ensures a repeatable, reliable result with every use. Every formed marker 160 will possess standard size and shape characteristics and will exit the golf ball position marking device 100 according to a predetermined vector position. In other words, each formed marker 160 lands at a predetermined distance relative to the point of contact between the golf ball and the green, and at a predetermined location in line with both the golf ball contact point and the hole in play.

In one embodiment, the putting green contact surface 140 further may comprise a deformable plastic or foam overmold material that conforms to the any random, uneven contour on the putting green surface that might otherwise deleteriously affect stability of the golf ball position marking device 100 during use. For example, such a conformable overmold may provide enough flexibility to absorb the contours of a stone that projects upward from the green and that otherwise would act as a fulcrum and prevent stable placement of the golf ball position marking device 100. In other embodiments, the putting green contact surface 140, may be contoured instead of substantially planar for use with various uneven playing surfaces.

Turing back to the embodiment of FIGS. 1A through 1C, the sloped putting green contact surface 140 also ensures that the golf ball position marking device 100 rests on the green at a predetermined, non-perpendicular angle in relation to the green surface. The slope of the putting green contact surface 140 thus ensures that the marker material dispensing port 110 remains positioned above the surface of the green and such that the dispensed marker material will eject from the golf ball marking device according to a predetermined vector and land at a predetermined vector position relative to the point at which the resting golf ball contacts the putting green. The dispensed marker material will eject at a proscribed angle imparted by the angle of the putting green contact surface 140 and the location of the dispensing port 110, and will travel a distance also determined by the position of the putting green contact surface 140 along the golf ball position marking device 100 and in relation to the marker material dispensing port 110. The substantially planar putting green contact surface 140, therefore, enables a golfer to position the golf ball position marking device 100 securely and readily such that the marker material will eject onto the green and create formed marker 160 at a repeatable, predetermined vector position relative to the position of the stationary golf ball.

Embodiments of the golf ball position marking device 100 may include additional features for enabling repeatable, exact positioning of the formed marker 160 in relation to the position of a stationary golf ball. For example, the embodiment of FIGS. 1A through 1C includes a curved alignment tip 152 for aiding in positioning the golf ball position marking device 100 in oriented alignment with the golf ball on the putting green, and a contoured depression 154 on a surface of the golf ball position marking device 100 substantially opposite to the putting green contact surface 140. FIG. 1A for example depicts the contoured depression 154 as having the shape of a complex curve that substantially follows the curved surface of a golf ball. Accordingly a golfer may position the curved alignment tip 152 close to a stationary golf ball without the risk of bumping and dislodging the golf ball because the contoured depression 154 accommodates the portion of the stationary golf ball extending upward and outward from the point at which the ball contacts the putting green. The embodiment of the golf ball position marking device 100 of FIGS. 1A through 1C therefore essentially cups the stationary golf ball without making contact, thereby enabling close positioning of the golf ball position marking device to the stationary golf ball and ensuring accurate placement of the formed marker 160 close to the point of contact between the golf ball and the putting green.

As FIG. 1B clearly depicts, the marker material dispensing port 110 is positioned in the middle of the curved alignment tip 152. Here, the alignment tip 152 follows a convex curve such that the marker material dispensing port 110 is positioned at the apex of the curve. Such placement assists with spacing the marker material dispensing port 110 from the putting green surface at a predetermined distance so that the formed marker 1601 ands at a predetermined distance and angle from the marker material dispensing port 110 and in relation to the point where the golf ball contacts the putting green. In alternate embodiments, the marker material dispensing port 110 may be located in alternative locations without reducing the efficacy of the golf ball position marking device 100 and without deviating from the spirit and scope of the present invention. In fact, the present invention is not limited to situations where the marker material dispensing port 110 is located in the golf ball position marking device 100. Instead, the marker material dispensing port 110 may be positioned in any manner that facilitates the reliable marking of the golf ball. For example, an extension arm may be attached to the golf ball position marking device 100 for wrapping around the stationary ball and ejecting the formed marker 160 at a desired location proximate to the golf ball.

In alternative embodiments, the marker material dispensing port may comprise additional features. For example, in one embodiment of the present invention, the marker material dispensing port 110 further comprises a screen filter disposed therein (not shown) for preventing external debris from entering the golf ball marking device and for aerating the marker material upon release, thereby producing a more foamy and more visible formed marker 160.

In addition to the key functional features that produce a formed marker 160, some embodiments of the golf ball position marking device 100 also may include additional features, such as storage for additional golf related tools. For example, as shown in FIGS. 1A and 1C, the golf ball position marking device 100 may include golf tee storage slots 172, a range finder 174 and/or a divot repair tool (not shown). The golf ball position marking device 100 may also include a knob 180 for attachment to a universal belt clip.

Turning now to FIG. 2, an alternative embodiment of the golf ball position marking device 200 comprises variations of the features of the embodiment of FIGS. 1A through 1C. This embodiment of the golf ball position marking device 200 comprises a marker material dispensing port 210, a marker material dispensing actuator 220, a marker material reservoir 230 and a putting green contact surface (not shown). In this embodiment of the present invention, the marker material reservoir 230 is an internal cartridge-type removable reservoir. Like the permanent, refillable interior reservoir, the cartridge-type marker material reservoir 230 ensures a sufficient supply of marker material during a golf round and may be either disposable or refillable. The marker material reservoir 230 also may include a marker material level indicator 234. In this embodiment, the marker material level indicator 234 is a window that provides a direct view of the remaining content of the marker material reservoir 230. In alternative embodiments, the marker material level indicator 234 may be a digital readout or e-paper read out that operates in conjunction with electronic level sensing means. Additionally, the embodiment of FIG. 2 further comprises a convex, tapered alignment tip 252 for assisting with oriented alignment of the golf ball position marking device 200 in close proximity to the golf ball.

Figure 3:
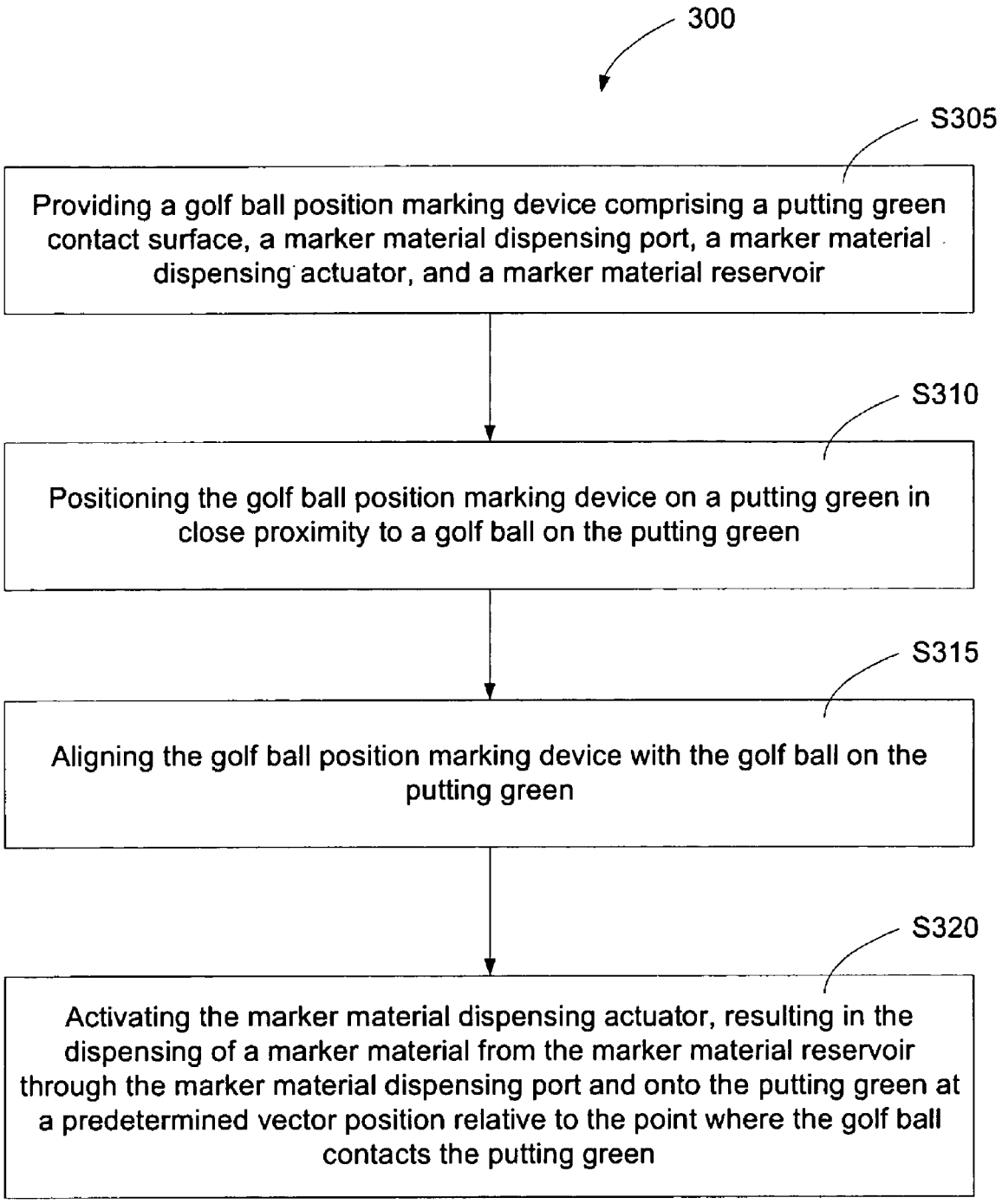
FIG. 3 shows one embodiment of a method of using a golf ball position marking device according to the present invention.

Turning now to FIG. 3, the present invention also comprises a method of using the golf ball position marking device 100. FIG. 3 depicts one embodiment of a method 300 of using the golf ball position marking device 100. A first step S305 comprises providing a golf ball position marking device 100 comprising the features described above with regard to the embodiments of FIGS. 1A through 2. A second step S310 comprises positioning the golf ball position marking device 100 on a putting green in close proximity to a golf ball. As described above, the putting green contact surface 140 enables secure positioning of the golf ball position marking device 100 on the putting green in relation to a stationary golf ball. After a user places the golf ball position marking device 100 in close proximity to the golf ball on the putting green, a third step S315 comprises aligning the golf ball position marking device 100 with the golf ball on the putting green. This third step S315 achieves the oriented alignment that results in placing a formed marker 160 on the putting green at a predetermined vector position relative to the point at which the golf ball contacts the putting green. Aligning the golf ball position marking device 100 with the golf ball may entail, for example, positioning the golf ball position marking device 100 such that the formed marker 160 lands proximate to the point of contact between the ball and the putting green, and at a spot behind the golf ball, i.e., 180 degrees from the point on the circumference of the ball that directly faces the hole in play. In embodiments comprising an alignment tip 152 and contoured depression 154, a user places the putting green contact surface 140 directly on the putting green and positions the curved alignment tip 152 and contoured depression 154 so that the golf ball position marking device rests directly behind and partially beneath the golf ball. The stability of the putting green contact surface 140, in combination with the accommodating curvatures of the alignment tip 152 and contoured depression 154, enable a golfer to position and align the golf ball position marking device 100 in a manner that reduces the risk of bumping and dislodging the stationary golf ball during the marking process.

A final method step S320 comprises activating the marker material dispensing actuator 120 and thereby producing a formed marker 160 on the putting green. Upon actuation of the dispensing actuator 120, the marker material propels from the marker material reservoir, through the marker material dispensing port 110 and onto the putting green at a predetermined vector position relative to the point at which the golf ball contacts the putting green.

In the embodiment of FIGS. 1A through 1C, the marker material dispensing actuator 120 is an ergonomically placed, contoured button that enables a user to grasp the golf ball position marking device comfortably in the palm of his hand and quickly place a finger in the contoured depression of the dispensing actuator 120. In this embodiment, the dispensing actuator 120 is positioned on a surface opposite the putting green contact surface 140 such that applying pressure to the dispensing actuator 120 also applies a force that keeps the putting green contact surface 140 in contact with the putting green. In other embodiments, the dispensing actuator 120 may be positioned elsewhere on the golf ball marking device 100. For example, the dispensing actuator 120 may extend from a side surface, a surface that is substantially perpendicular to the putting green contact surface 140. Such orientation would enable easy reach, for example, by a thumb rather than a forefinger in an overhand grab of the golf ball marking device 100.

In one embodiment, the marker material dispensing actuator 120 is a spring fed slide that, when depressed by an index finger for example, dispenses a selectable amount of marker material from the marker material reservoir. In another embodiment, the dispensing actuator 120 may be a pressure inducer that expels marking material from an internal plenum or collapsible bladder, and a user may selectively adjust the amount of marker material dispensed from the golf ball position marker 100 by depressing the marker material dispensing actuator 120 for an extended or shortened interval and/or with greater or lesser force. A golfer may wish to apply more or less marker material under certain conditions that may affect visibility of the mark. Such conditions may include, for example, the length of the putting green grass, the moisture level of the putting green or the intended area and distribution of the golf ball position mark 160.

In still yet another embodiment, the marker material dispensing actuator 120 may be controlled by an electronic means. One embodiment of the golf ball marker device 100 may be electronically powered, including, for example, a disposable and/or rechargeable battery, an adapter port for recharging a rechargeable battery, a battery life indicator light, and an electronic actuator for interpreting electrical impulses from the dispensing actuator 120 and expelling a selected amount of marking material through the marking material dispensing port 110. Such an electronic golf ball position marking device also may include an application specific integrated circuit (ASIC) for controlling functions of the device, such as producing a formed marker 160 upon request and indicating marker material content level on a digital readout, for example. Such an electronic embodiment of the golf ball position marking device 100 further may comprise memory means, such as flash and EEPROM or ROM, and a port, such as a USB port, for uploading and transmitting data accumulated during use. For example, this embodiment of the golf ball position marking device may include means for inputting and recording scores during play and means for displaying uploadable course information.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

I claim:

1. A method for marking the position of a golf ball comprising:

a) providing a golf ball position marking device comprising a putting green contact surface, a foaming agent dispensing port, a foaming agent dispensing actuator and a foaming agent reservoir, wherein i) the putting green contact surface is sized and shaped to permit stable positioning of the golf ball position marking device on a putting green in close proximity to a golf ball on the putting green thereby providing oriented alignment of the golf ball position marking device with the golf ball on the putting green; and ii) the foaming agent dispensing port is positioned such that when the golf ball position marking device is positioned in oriented alignment relative to the golf ball, activation of the foaming agent dispensing actuator results in the dispensing of a foaming agent from the foaming agent reservoir onto the putting green at a predetermined vector position relative to the point where the golf ball contacts the putting green;

b) positioning the golf ball position marking device on a putting green in close proximity to a golf ball on the putting green;

c) aligning the golf ball position marking device with the golf ball on the putting green;

d) activating the foaming agent dispensing actuator, resulting in the dispensing of a foaming agent from the foaming agent reservoir through the foaming agent dispensing port and onto the putting green at a predetermined vector position relative to the point where the golf ball contacts the putting green.

2. The method of claim 1 wherein the foaming agent is grey water safe.

3. The method of claim 1 wherein the dispensed foaming agent is visible to the human eye.

4. The method of claim 1 wherein the dispensed foaming agent creates a mark that is substantially flat.

5. The method of claim 1 further comprising a screen covering the foaming agent dispensing port.

6. The method of claim 1 wherein the body of the golf ball position marking device further comprises a curved alignment tip for aiding in positioning the golf ball marking device in oriented alignment with the golf ball on the putting green.

7. The golf ball position marking device of claim 6 wherein the dispensing port is disposed on the curved alignment tip.

* * * * *